United States Patent [19]

Nogi et al.

[11] Patent Number: 4,583,726

[45] Date of Patent: Apr. 22, 1986

[54] APPARATUS FOR COUNTING THE NUMBER OF PAPER SHEETS

[75] Inventors: Hiroyoshi Nogi; Hiroyuki Ookawa, both of Tokyo, Japan

[73] Assignee: Musashi Engineering Kabushiki Kaisha, Tokyo, Japan

[21] Appl. No.: 562,699

[22] Filed: Dec. 19, 1983

[30] Foreign Application Priority Data

Dec. 28, 1982 [JP] Japan ..... 57-195910

[51] Int. Cl.[4] ..... B65H 3/06; B65H 5/06

[52] U.S. Cl. ..... 271/4; 271/119; 271/122; 271/274

[58] Field of Search ..... 271/109, 37, 18, 119, 271/21, 93, 94, 4, 272, 273, 274, 121, 122, 124, 125; 226/180, 186, 187, 194

[56] References Cited

U.S. PATENT DOCUMENTS

| | | | |
|---|---|---|---|
| 4,034,976 | 7/1977 | Lundblad | 271/122 X |
| 4,056,263 | 10/1977 | LaWhite et al. | 271/275 X |
| 4,275,874 | 6/1981 | DiBlasio | 271/4 |

FOREIGN PATENT DOCUMENTS

| | | | |
|---|---|---|---|
| 0038225 | 3/1977 | Japan | 271/273 |
| 0100043 | 6/1983 | Japan | 271/275 |
| 0224926 | 12/1983 | Japan | 271/109 |

OTHER PUBLICATIONS

Beuch, W. E. et al., "Transport Assembly and Latch for Document Card Machine", IBM Technical Disclosure Bulletin, vol. 17, No. 16, Nov. 1974, p. 1745.

*Primary Examiner*—Bruce H. Stoner, Jr.
*Assistant Examiner*—Lawrence J. Goffney, Jr.
*Attorney, Agent, or Firm*—Brooks Haidt Haffner & Delahunty

[57] ABSTRACT

A sheet transfer apparatus is for a sheet counting apparatus in which paper sheets stored in a hopper in a stacked state are fed by a payout roll from the hopper to a stacker at the downstream side of the payout roll. A guide assembly is disposed opposite to the periphery of the payout roll and is adapted to separately guide the paper sheets from the hopper toward the stacker in cooperation with the payout roll. According to the invention, the guide assembly, which has a frame member carrying a separating roll, a pinch roll and a guide plate, is pivotally mounted so as to be movable between a closed position in which it is close to the periphery of the feed-out roll and an opened position in which it is farther away from such roll. The position of the frame member is controlled by a pivotable opening/closing device engageable with the frame member for selectively holding the frame member in the closed position or the opened position.

4 Claims, 4 Drawing Figures

APPARATUS FOR COUNTING THE NUMBER OF PAPER SHEETS

BACKGROUND OF THE INVENTION

This invention relates to an apparatus for counting the number of paper sheets. More particularly, it relates to such apparatus in which the paper sheets stored in the hopper are fed out one by one towards a downstream device, e.g. a stacker by means of a payout roll adapted for cooperating with a separating roll and a pinch roll.

Heretofore, in this type of the apparatus, means cooperating with the payout roll for feeding or reeling out paper sheets, such as the separating roll or pinch roll, is mounted in a fixed position. Thus, when the paper sheets being fed out have become stuffed in the gap between said feed-out means and the payout roll, these paper sheets need be removed by a troublesome and time-consuming operation, thus causing great costs and labor in maintenance and repair.

SUMMARY OF THE INVENTION

It is an object of the present invention to provide means for effectively obviating the foregoing deficiency and more particularly to provide an arrangement in which the guide unit or assembly comprised of the separating roll and the pinch roll is supported by a movable frame member, and in which the guide unit may be moved by an opening/closing device between its open and closed positions.

DESCRIPTION OF THE PREFERRED EMBODIMENT

Reference is now had to the accompanying drawings showing a preferred embodiment of the paper sheet counting apparatus according to the present invention.

Figure 1:
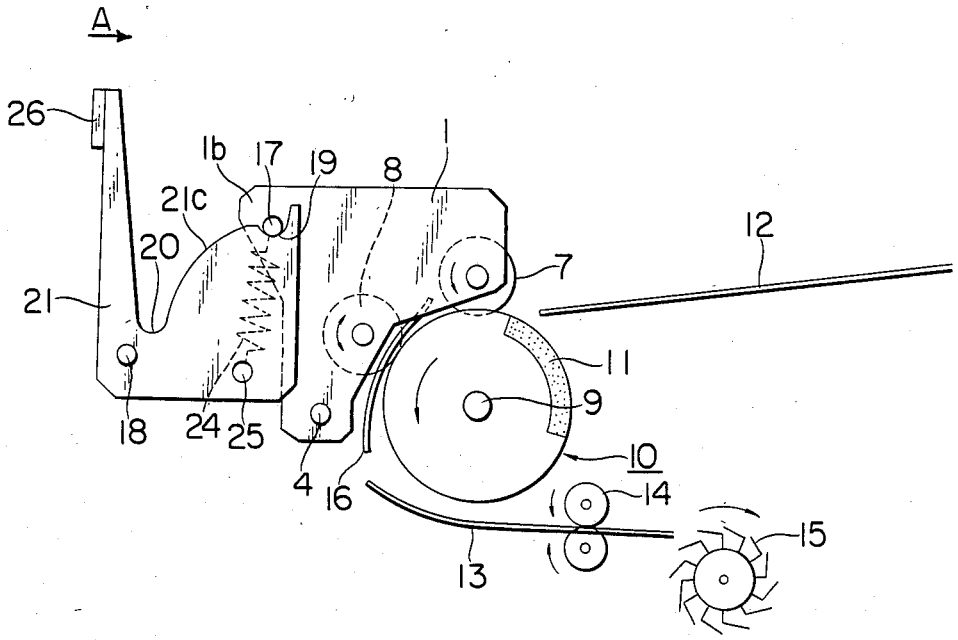
FIG. 1 is a schematic side view showing the paper sheet counting apparatus provided with the guide unit opening and closing device according to the present invention.
Figure 2:
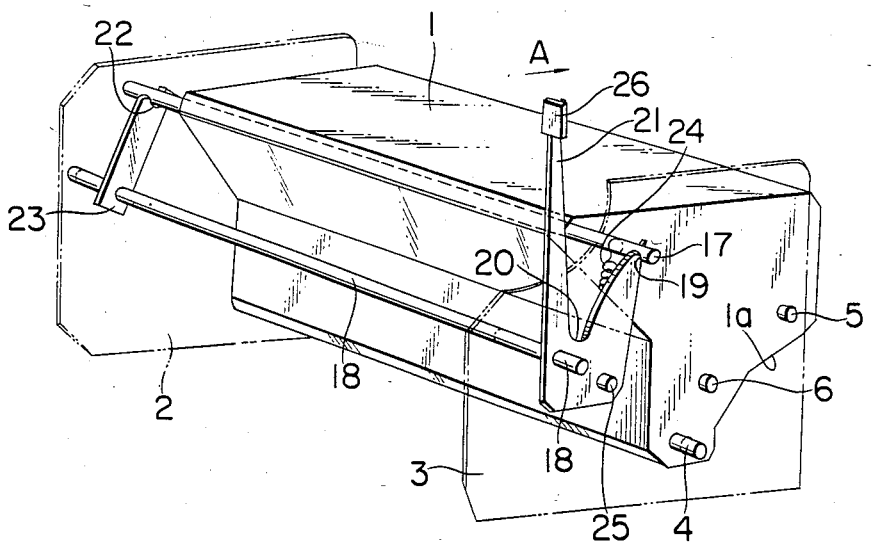
FIG. 2 is a perspective view showing the guide unit shown in FIG. 1.

In FIGS. 1 and 2, a box-like frame member 1 is rotatably supported through a supporting shaft 4 by flanges 2, 3 of a main body of the apparatus, not shown. In a lower opening 1*a* of the frame member 1, there are mounted a separating roll 7 and a pinch roll 8 an the housing side wall by means of a separating roll shaft 5 and a pinch roll shaft 6, respectively, in a mutually spaced apart relation and so as to be rotated by driving means, not shown. A payout roll 10 is rotatably supported by said flanges 2, 3 through a payout roll shaft 9. A portion of the outer periphery of the payout roll 10 is formed as a highly frictional surface 11 made e.g. of rubber. A hopper 12 in which the paper sheets are stacked is provided above the payout roll 10, while a lower guide plate 13, a pair of extracting rolls 14 and a vane stacker 15 are mounted below the payout roll 10. The upper guide plate 16 is extended at one end into the lower opening 1*a* of the frame member 1 and disposed at the other and above the one end of the lower guide plate 13. The upper guide plate 16 is carried by the frame member 1 and cooperates with the separating roll 7 and the pinch roll 8 for providing a guide unit.

A frame opening shaft 17 is integrally mounted on an upper portion 1*b* of the frame member 1, and a supporting shaft 18 is carried by the flanges 2, 3. A frame opening lever 21 having a first locking groove 19 and a second locking groove 20 is integrally mounted at one end of the supporting shaft 18, and a locking lever 23 having a locking groove 22 is secured to the other end of the shaft 18. A spring 24 engaged at one end with the opening shaft 17 is engaged at the other by a stud 25 provided at the lower part of the opening lever 21. The upper end of the frame opening lever carries a frame opening button 26.

Figure 3:
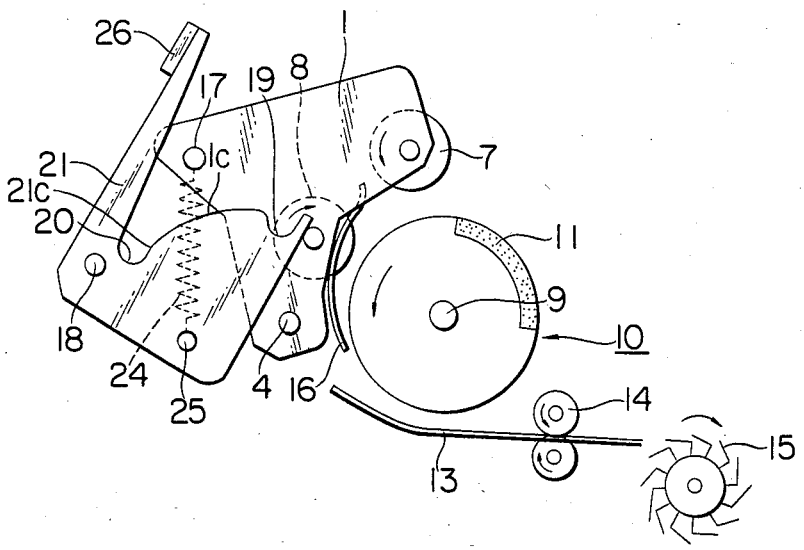
FIGS. 3 and 4 are schematic side views for explaining the operation of the guide unit opening/closing device.
Figure 4:
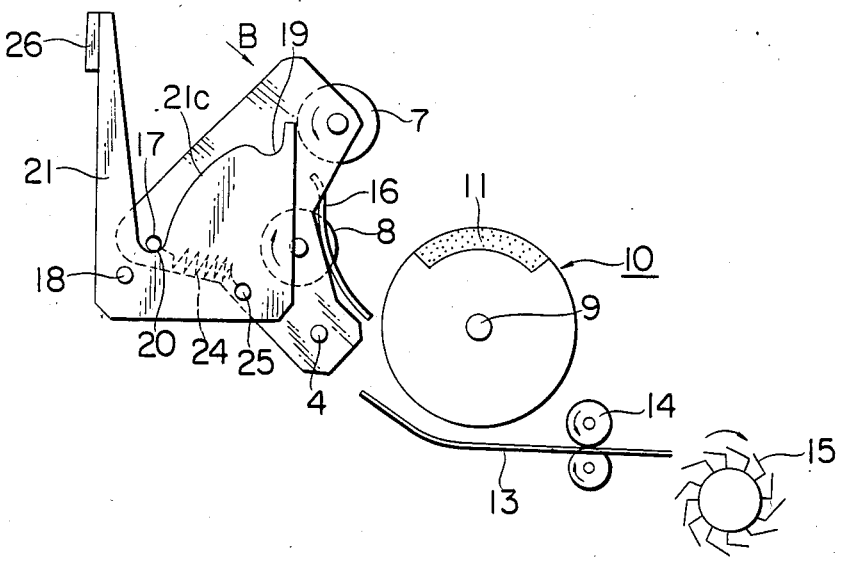

With the aforementioned construction, when it is desired to actuate the guide unit opening and closing device of the paper sheet counting apparatus according to the present invention, the opening button 26 of the opening lever 21 is pushed in the direction of the arrow marked A starting from the state shown in FIG. 1. This disengages the frame opening shaft 17 of the frame 1 from the first locking groove 19 of the opening lever 21 and the locking groove 22 of the locking lever 23. The shaft 17 slides on guide surface 21*c* of the opening lever 21 as shown in FIG. 3 and finally engages in the second locking groove 20 of the opening lever 21 as shown in FIG. 4. The frame member 1 is moved away from the payout roll 10 and kept in the open state for opening the guide unit.

When the frame member 1 is returned from the open state of the frame member 1 shown in FIG. 4 to the closed state shown in FIG. 1, the upper surface of the frame member 1 is moved manually in the direction of the arrow marked B, starting from the opening state shown in FIG. 4. By the reverse of the procedure depicted in the foregoing, the opening shaft 17 is shifted from the second locking groove 20 to the first locking groove 19 of the opening lever 21 and engaged again in the locking groove 22 of the locking lever 23, thus returning to the state shown in FIG. 1, the guide unit being thus kept in the closed state.

In the closed state shown in FIG. 1, when the separating roll 7, pinch roll 8 and the payout roll 10 are rotated in the direction shown by the associated arrow marks, the paper sheets (not shown) placed in the hopper are separated and intermittently fed out by the payout roll 10. The sheets are then extracted by the set of extracting rolls 14 through the upper guide plate 16 and the lower guide plate 13 and stacked by vane stacker 15 in a bandsealing unit (not shown) where they are bandsealed automatically.

From the foregoing it is seen that the guide unit may be easily maintained in the opened state by the operation of the opening and closing device, thus providing for more facilitated maintenance and inspection of the apparatus and improved operational reliability.

What we claim is:

1. Sheet transfer apparatus for sheet counting apparatus, said transfer apparatus comprising a hopper for receiving stacked sheets, a payout roll adjacent said hopper for feeding sheets out of said hopper, a stacker for receiving the sheets fed out of said hopper and disposed downstream of said payout roll, and guide means adjacent the periphery of said payout roll for guiding said sheets as they are fed by said payout roll from said hopper to said stacker and pass between said payout roll and said guide means, wherein the improvement comprises a movable support for said guide means for moving said guide means into a first position close to the periphery of said payout roll and, alternatively, into a second position farther away from the periphery of said payout roll, said movable support comprising a frame member with a pair of end flanges, said frame member being pivotably mounted at said flanges for movement toward and away from said payout roll, and said guide means comprising a plate mounted on said frame member and extending both axially and circumferentially of said payout roll, and a control means slidably engaging said support and mounted for movement relative to said support and from a first position to a second position, said control means in said first position thereof holding said guide means in said first position thereof for guiding said sheets as they pass between said payout roll and said guide means and, with movement of said control means to said second position thereof, said control means moves said support away from said periphery of said payout roll and hence, moves said guide means into said second position of said guide means, said control means comprising a lever pivotally mounted for movement toward and away from said frame member and having portions spaced from its pivot axis engageable with said frame member, one of said portions being engageable with said frame member in said first position of said control means and another of said portions being engageable with said frame member in said second position of said control means.

2. Sheet transfer apparatus as set forth in claim 1 wherein said movable support is pivotally mounted, said guide means is mounted on said movable support at a point thereon spaced from the pivot axis of said movable support, and said control means is pivotally mounted with portions thereof spaced from the pivot axis of said control means and engageable with said movable support.

3. Sheet transfer apparatus as set forth in claim 1 further comprising a separating roll mounted on said movable support and movable therewith toward and away from said payout roll, and a pinch roll mounted on said movable support and movable therewith toward and away from said payout roll.

4. Sheet transfer apparatus as set forth in claim 1 wherein said portions are defined by grooves in said lever, wherein said lever is secured to a rotatable shaft for rotation of the latter, wherein said control means further comprises a further lever secured to said shaft for movement thereby around the axis of said shaft with rotation of said shaft, said further lever having an end portion engageable with said frame member which, in said first position of said control means, locks said frame member and hence, said support, in said first position of said support, and a spring acting between said first mentioned lever and said frame member and urging said frame member toward said first-mentioned lever.

* * * * *